US007354506B2

(12) United States Patent
Meneghini et al.

(10) Patent No.: US 7,354,506 B2
(45) **Date of Patent: *Apr. 8, 2008**

(54) DIAPHRAGM CELL FOR CHLOR-ALKALI PRODUCTION WITH INCREASED ELECTRODE SURFACE AND METHOD OF MANUFACTURE THEREOF

(75) Inventors: Giovanni Meneghini, Milan (IT); Décio Barros, Sao Paulo (BR)

(73) Assignee: De Nora Electrodi S.p.A., Milan (IT)

( * ) Notice: Subject to any disclaimer, the term of this patent is extended or adjusted under 35 U.S.C. 154(b) by 590 days.

This patent is subject to a terminal disclaimer.

(21) Appl. No.: 10/490,134

(22) PCT Filed: Sep. 27, 2002

(86) PCT No.: PCT/EP02/10848

§ 371 (c)(1),
(2), (4) Date: Mar. 18, 2004

(87) PCT Pub. No.: WO03/029522

PCT Pub. Date: Apr. 10, 2003

(65) Prior Publication Data

US 2004/0238351 A1 Dec. 2, 2004

(30) Foreign Application Priority Data

Sep. 27, 2001 (IT) ..... MI2001A2003

(51) Int. Cl.
*C25B 1/46* (2006.01)
*C25B 9/08* (2006.01)
*C25B 9/18* (2006.01)

(52) U.S. Cl. ..... 204/253; 204/257; 204/258; 205/516; 205/517

(58) Field of Classification Search ..... None
See application file for complete search history.

(56) References Cited

U.S. PATENT DOCUMENTS

| | | | | |
|---|---|---|---|---|
| 4,118,306 | A | 10/1978 | De Nora | |
| 4,137,136 | A | 1/1979 | Ueda et al. | |
| 4,197,179 | A * | 4/1980 | Ezzell et al. | 204/255 |
| 4,236,983 | A | 12/1980 | Minz et al. | |
| 4,402,810 | A | 9/1983 | Boulton et al. | |

FOREIGN PATENT DOCUMENTS

| | | |
|---|---|---|
| WO | WO 03/074765 | 9/2003 |

* cited by examiner

*Primary Examiner*—Harry D. Wilkins, III
(74) *Attorney, Agent, or Firm*—Charles A. Muserlian

(57) ABSTRACT

The invention relates to a diaphragm electrolytic cell, for the production of chlorine and caustic soda having superimposed modules, and a method for increasing the electrodic surface of a diaphragm electrolytic cell constituted by a module of interdigitated anodes and cathodes which foresees an additional cell module having the same geometry as that of the original cell. The additional module is hydraulically connected in series and electrically connected in parallel to the existing module.

12 Claims, 5 Drawing Sheets

DIAPHRAGM CELL FOR CHLOR-ALKALI PRODUCTION WITH INCREASED ELECTRODE SURFACE AND METHOD OF MANUFACTURE THEREOF

This application is a 371 of PCT/EP02/10848 filed Sep. 27, 2002.

BACKGROUND OF THE INVENTION

The world-wide production of chlorine, about 45 millions of tons per year, is carried out in electrolytic cells of various types, one of the most relevant being the diaphragm electrolysis cell, whereby about 22 millions of tons per year of chlorine are produced.

An electrolysis diaphragm cell is generally made of four main parts, as widely known to the experts of the art: a copper anodic base lined with a protective titanium sheet, an anodic package made of a multiplicity of anodes arranged in parallel rows and secured to the base, an iron cathodic body comprising a plurality of cathodes with a semipermeable diaphragm deposited thereon, fixed to a current distributor and arranged in parallel rows interposed to the anodes according to a so-called "finger-type" geometry, and a cover, usually made of chlorine-resistant plastic material provided with inlets for feeding brine and outlets for discharging the product chlorine.

In consideration of the high number of operating cells (about 25,000 in the world), of the high amount of energy required for their operation (about 60 millions of MWh/year) and of the continuous increase in the cost of electric energy, the diaphragm cell technology has been considerably improved during these years. Among the various technological improvements contributing to reducing the energy consumption, the following should be mentioned:

- replacement of the traditional graphite anodes with perforated box-shaped metal anodes (the so-called "box type" anodes) made of titanium coated with electrocatalytic materials based on noble metals and/or oxides thereof.
- the replacement of "box type" anodes, of fixed dimensions, with the so-called "expandable anodes", as described in U.S. Pat. No. 3,674,676, allowing the reduction of the interelectrodic gap
- the achievement of a zero-gap cell design by means of the introduction, within the expandable anodes, of suitable devices for pressing the anodes against the diaphragm, as described in U.S. Pat. No. 5,534,122
- the introduction of internal electrolyte recirculation devices, as described in U.S. Pat. No. 5,066,378.
- the catalytic activation of the cathode, by means of the application of an activated intermediate element on the cathodic surface or by the catalytic activation of the diaphragm itself.

As can be observed, the above mentioned improvements are all directed to obtain better performances in terms of energy consumption by increasing the electrocatalytic activity, or by optimising the electrode structure, or again by decreasing the interelectrodic gap and increasing the mass transfer (lower bubble effect and higher electrolyte circulation) achieved by small modifications which do not imply a substantial redesigning of the cell structure and thus can be easily applied with reduced costs.

In many cases, however, it would be preferable to lower the energy consumption by increasing the electrodic surface while keeping the same current load, thereby decreasing the current density and consequently the cell voltage. This situation is typically experienced in the operation of existing cells, due to variations in the price of electric energy, or to the incoming availability of electrical components capable of withstanding a greater load. This can be particularly critical in case of lack of available space on the plant site for installing new electrolytic cells in addition to the existing ones. For this reason, in the past, several solution involving the modification of the cell structure, and in particular of the anodic package and of the cathodic body, have been proposed. Although these improvements entail a very significant energy saving, in the same range of the previously mentioned ones or even higher, they are of lower relevance and commercial success as they involve remarkable modifications of the internal cell structure or variations of the external dimensions, implying strong investment costs and long construction and pay-back times. Among these solutions, the following can be mentioned:

a) increase of the ratio between the electrodic surface and the volume of the cell by internal modifications of the latter, namely:
   - substitution of the whole cathode package with a new one, having the same overall dimensions but a reduced spacing between fingers (finger pitch), so that a higher number of fingers is installed and a proportional increase of the cathodic surface is obtained.
   - new perforation of the anodic base to adapt the position of the anodes to the new finger pitch of the cathodic package.
   - insertion of a number of new anodes, identical to the old ones, between the fingers of the cathodic package giving rise to an analogous increase of the anodic surface.

No external modifications are conversely required. This method may be applied when there is sufficient space for reducing the finger pitch and is generally applicable to cells of the old technology, conceived for operation with graphite anodes and thus having a higher pitch between one finger and the next; commonly, the increase in the surface that can be achieved does not exceed 2-5% of the existing surface. The investment is economically viable when the cathodic package has to be substituted at the end of its lifetime, which usually happens every 6-8 years. The retrofitting times are therefore long.

b) increase of the cathodic package height and substitution or modification of the existing anodes.

This technique implies substantial modifications inside the cell, including the complete substitution of the cathodic body and the substitution or modification of the existing anodes.

Small modifications are required also outside the cell, especially as concerns the hydraulic connections, even though they are not very significant from an economic standpoint; however this method, although offering the advantage of a greater increase of the electrodic surface (5-15%), is much more expensive and has very long retrofitting times: it is therefore economically interesting only when the cathodic package must be in any case relpaced being close to the end of its operating lifetime (every 12-16 years).

As a conclusion, the two latter methods, although easily applicable from a technical standpoint, have the great disadvantage of being very expensive and entailing long retrofitting times, posing problems of pay-back and being economically convenient only in case of a concurrent substitution of the anodic package or cathodic body. It is an object of the present invention to provide a diaphragm electrolytic cell for chlor-alkali production which overcomes the shortcomings of the prior art.

In particular, it is an object of the present invention to provide a diaphragm electrolytic cell having an increased electrodic area.

Under another aspect, it is an object of the present invention to provide a method for obtaining a diaphragm electrolytic cell having an increased electrodic area starting from a conventional cell.

Under another aspect, the invention comprises an electrolytic diaphragm cell including a plurality of anodic packages arranged on a plurality of overlaid planes. Under a further aspect, the invention comprises a method for increasing the electrodic active area of a diaphragm cell without replacing or removing the pre-existing anodic and cathodic packages.

Under a further aspect, the invention comprises a method for increasing the active area of a diaphragm cell wherein the base surface of the cell is maintained constant.

SUMMARY OF THE INVENTION

According to a preferred embodiment, the cell of the invention comprises a plurality of modules, each one defined by interdigitated anodic and cathodic packages. The height of the various modules may vary while the number of anodes and cathodes and the pitch thereof is preferably constant. Preferably, the modules are mutually overlaid so that a direct geometric correspondence is established between the anodes and cathodes of the different modules. In a preferred embodiment, the modules are two, the upper module having a lower height than the lower module. According to a preferred embodiment, the different modules are electrically connected in parallel. According to a preferred embodiment, the modules are hydraulically connected in series. According to a preferred embodiment, the diaphragm is a semipermeable diaphragm made of asbestos or of a synthetic material. According to another embodiment, the diaphragm is an ion-exchange membrane.

According to a preferred embodiment, the method of the invention comprises increasing the active surface of an electrolytic diaphragm cell of the conventional type by installing a new module comprising a new anodic package and a new cathodic package overlaid to the pre-existing anodic and cathodic packages. According to a preferred embodiment, the new module is installed between the pre-existing anodic body and the cover of the cell whose the surface is to be expanded.

According to a further preferred embodiment, the new module is electrically connected in series to the pre-existing module. According to a further preferred embodiment, the new module is hydraulically connected in series to the pre-existing module.

According to a preferred embodiment, the new module comprises an anodic package and a cathodic package substantially having the same pitches as those of the existing anodic and cathodic packages, with a lower height.

Under one aspect, the cost reduction is given by the fact that the new method does not imply any modification or substitution of the pre-existing electrodic packages, which in a preferred embodiment represent about 60-70% of the total. As a matter of fact, the costs are substantially proportional to the required surface increase, in other words to the height of the new module and of the electric bars.

BRIEF DESCRIPTION OF THE DRAWINGS

The invention will be more easily understood making reference to the enclosed figures, but it is evident that an expert of the field will easily identify several equivalent solutions in addition to those illustrated herein.

DETAILED DESCRIPTION OF THE DRAWINGS

Figure 1:
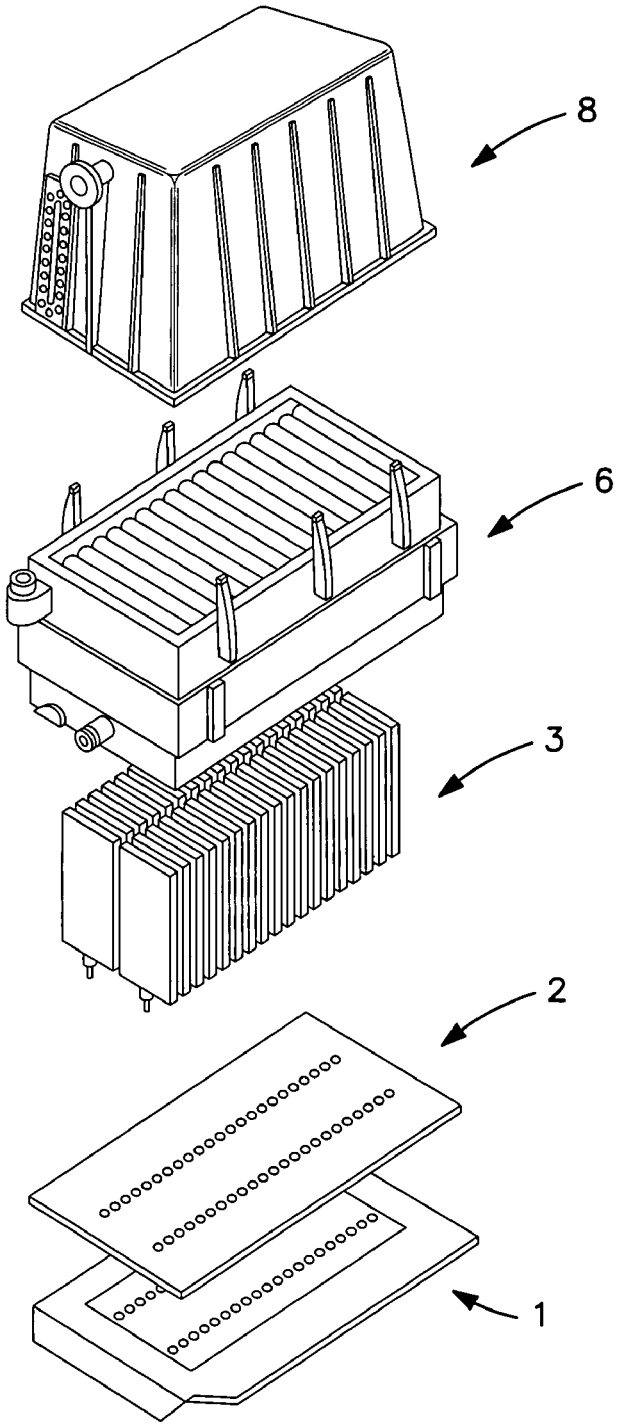
FIG. 1 PRIOR ART
FIG. 1 is an axonometric view of a diaphragm electrolytic cell of the prior art.
Figure 2:
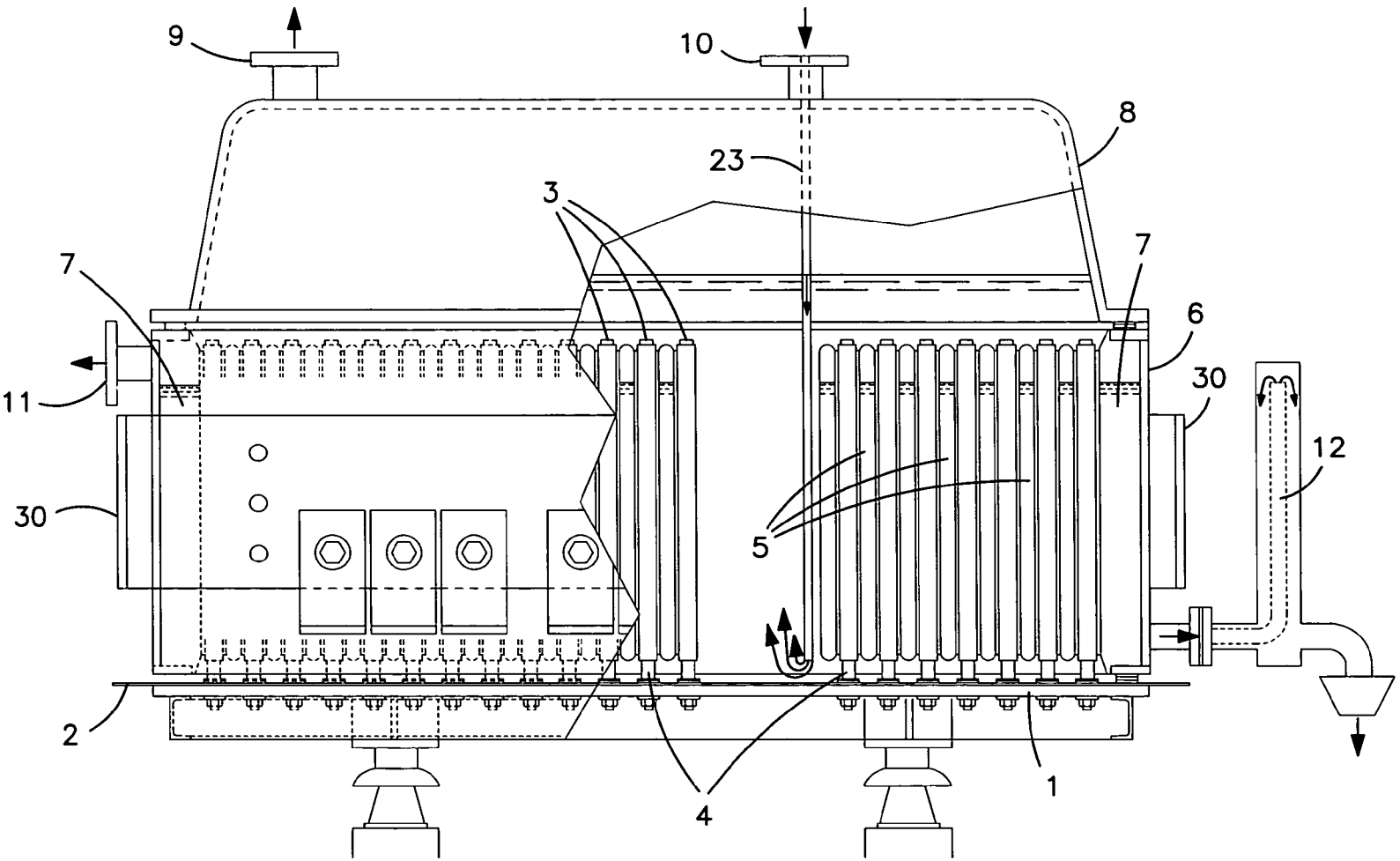
FIG. 2 PRIOR ART
FIG. 2 is a side view of a diaphragm electrolytic cell of the prior art.
Figure 3:
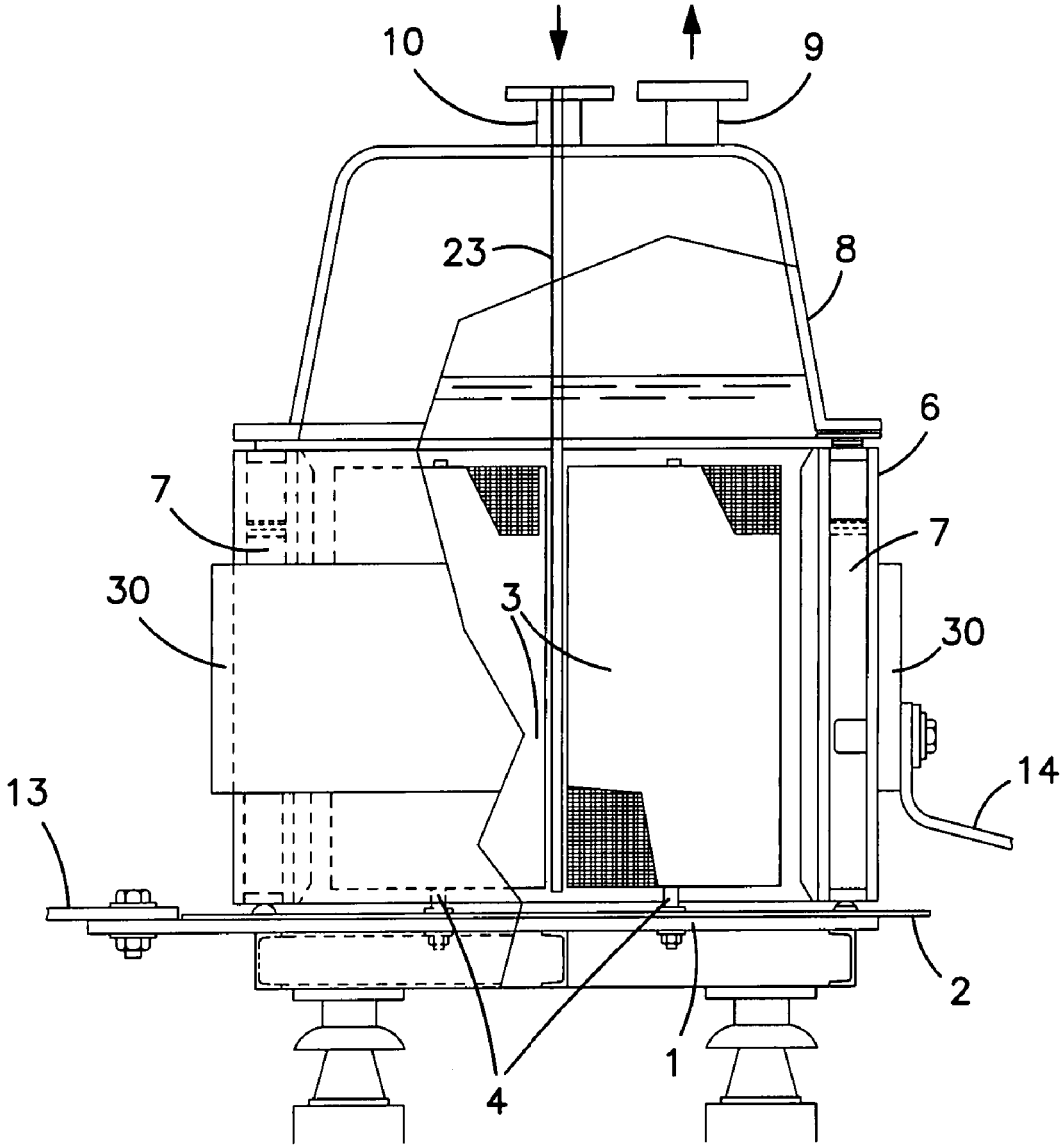
FIG. 3 PRIOR ART
FIG. 3 is a front view of a diaphragm electrolytic cell of the prior art.

Making reference to FIGS. 1, 2 and 3, a diaphragm electrolytic cell of the prior art is made of a copper anode base (1), whereupon a titanium protective sheet is laid and whereto a plurality of anodes (3) is secured in parallel rows, by means of current collecting stems (4) intercalated to the cathodes (5). The surface of the anodes is preferably made of a grid of perforated or rhomboidal-shaped expanded sheet coated with electrocatalytic material: the overall surfaces of all the anodes constitute the anodic surface of the cell. The cathode consists of a box (6) with open top and bottom, known as cathodic body, with a current distributor (30), provided with a plurality of cathodes (5) fixed inside, secured in correspondence of the external surface thereof. The cathodes (5), known as "fingers" or "channels", are shaped as tubular boxes with a flat elongated cross-section and are arranged in parallel rows intercalated to the rows of anodes (3); the two ends of the cathodes (5) are connected with a manifold (7) running along the four sides of the box (6). The cathode is made for example of an iron perforated sheet or mesh, with the diaphragm deposited on the external surface thereto, facing the anode. The diaphragm has the purpose of separating the anodic compartment from the cathodic one avoiding the mixing of the two gases and of the solutions; originally it was made of polymer modified asbestos, but the technological evolution has led to the adoption of composite asbestos-free diaphragms. The diaphragm may also consist in an ion-exchange membrane or other semipermeable material. The surface of all the fingers constitutes the cathodic surface of the cell, which is about equivalent to the anodic surface. The cover (8), which is made a of plastic chlorine-resistant material, is provided with a chlorine gas outlet (9) and a brine inlet (10). Hydrogen leaves from nozzle (11) of the cathodic body, and the caustic solution leaves through an adjustable hydraulic head (12). The cell is connected to a direct current supply by means of the anodic (13) and cathodic (14) bus bars.

Figure 4:
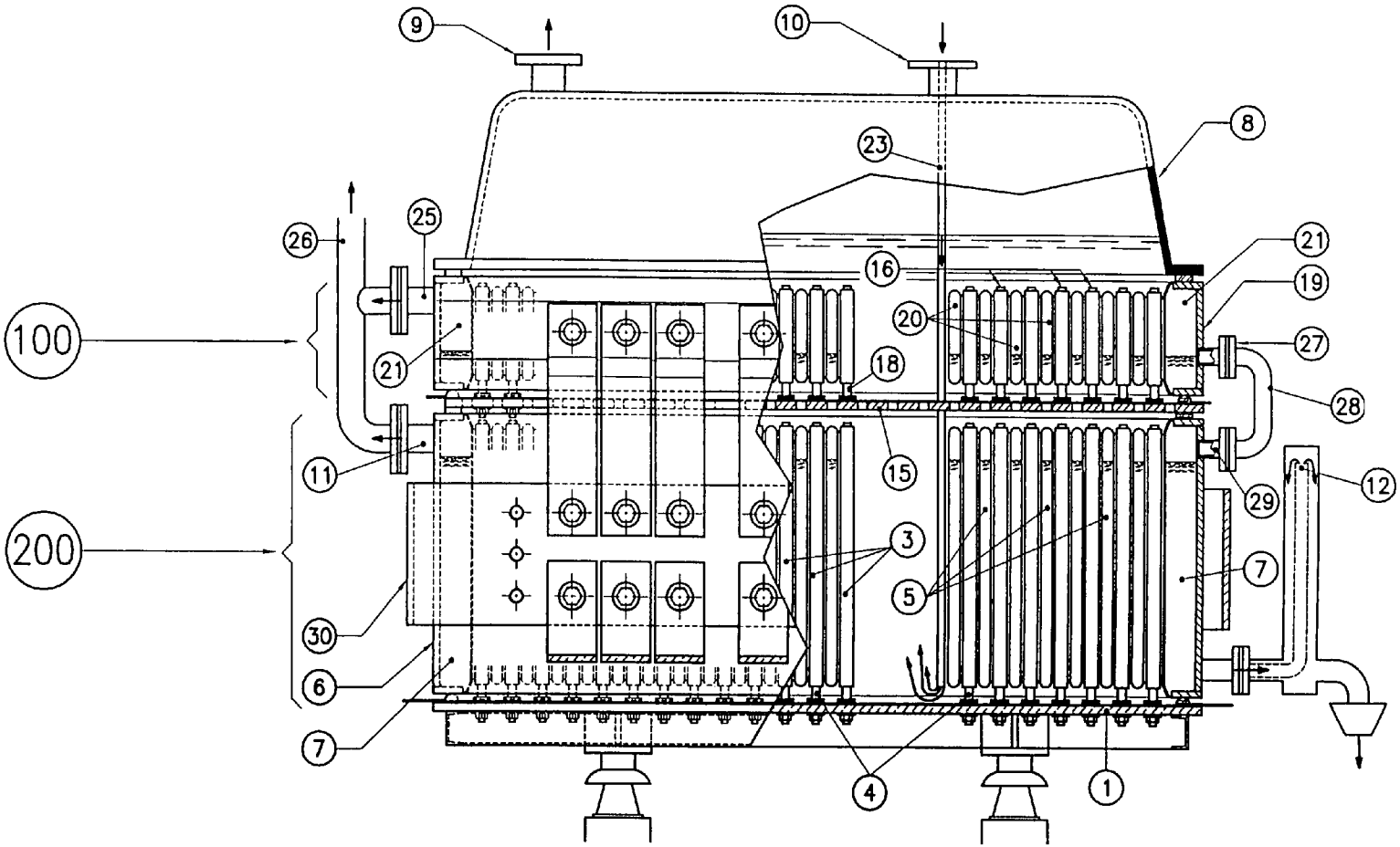
FIG. 4 is a side view of a diaphragm electrolytic cell of the invention.
Figure 5:
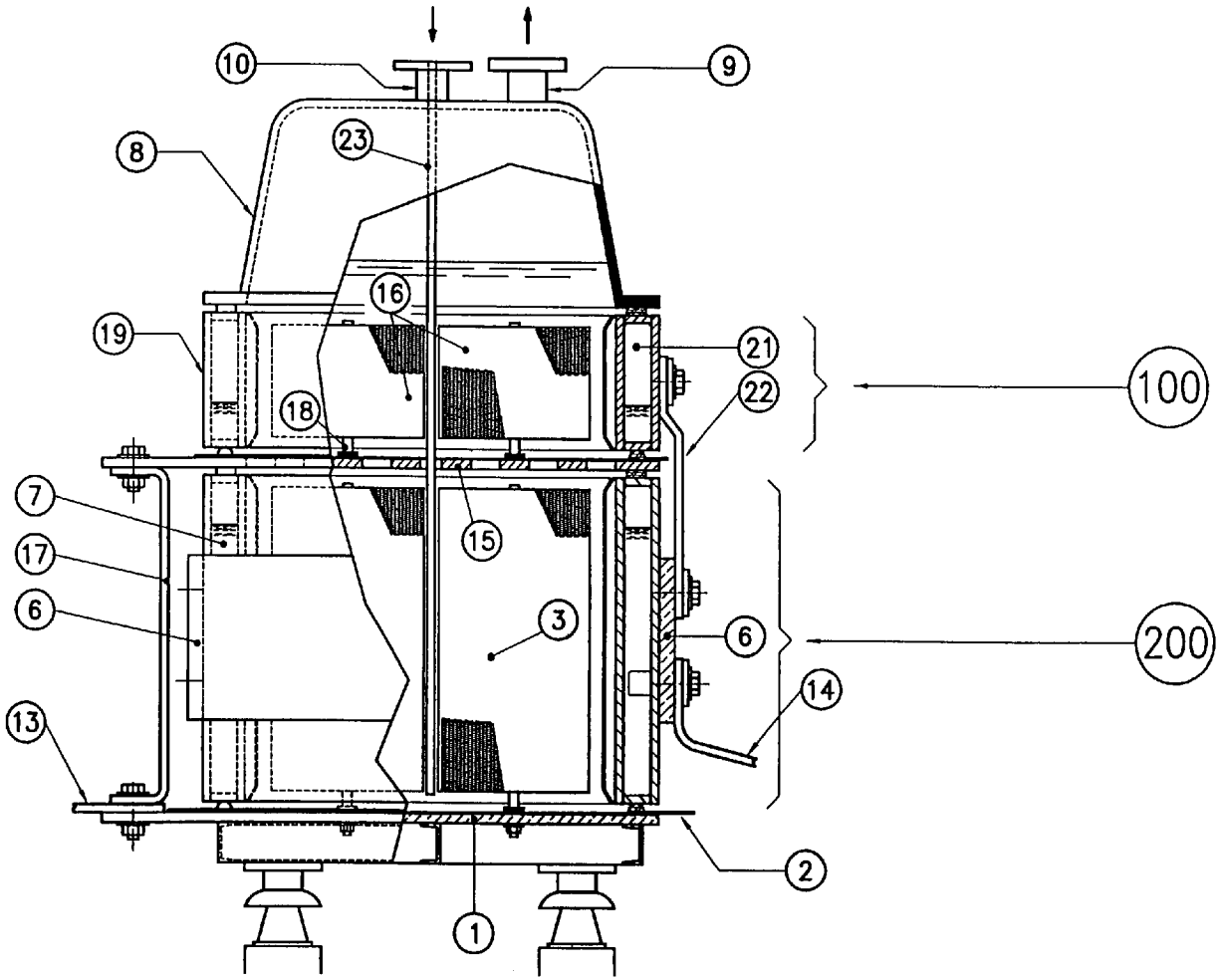
FIG. 5 is a front view of a diaphragm electrolytic cell of the invention.

Making reference to FIGS. 4 and 5, the cell of the invention differs over one of the prior art by the addition of a new module (100) between the pre-existing cathodic body (200) and cover (8). The new module comprises new anodic and cathodic packages, substantially with the same projected surface and construction materials as the pre-existing ones and in most of the cases a lower height. According to the embodiment illustrated in FIGS. 4 and 5, the new anodic package comprises a frame (15), which acts both as a mechanical support and current distributor for the additional anodes (16). The frame (15) is made of a titanium sheet provided with holes or slots, suitably dimensioned for putting the two anodic compartments in direct fluid communication, preferably in series, and permitting the passage of fluids. The additional anodes (16) are vertically fixed to the frame, in transversal rows, with the same pitch as that of the anodic package of the cell to be modified so that to each row of anodes of the new anodic package corresponds one of the pre-existing anodic package. Finally, new copper current conducting bars (17), connected in parallel to the existing anodic base (1), are applied to the frame (15). The additional anodes (16), fixed to the frame (15) by means of dowel screws (18), have an electrodic surface consisting for example of a grid of a perforated sheet or of expanded sheet with rhomboidal openings coated with an electrocatalytic material equivalent to that of the existing anodes; the height is defined as a function of the required surface increase. The sum of all the anode surfaces of the anodic package constitutes the anodic surface of the new module. The new cathodic body is made of a box (19), having the same projected surface, design and construction materials as those of the existing cell and a height depending on that of the new anodic package; a new cathodic body is welded along the internal walls of the box (19) which is made of a plurality of cathodes (20), for example made of expanded sheet or interwoven wire, arranged in parallel rows with the same finger pitch as the one of the pre-existing cathodic package. Each finger, shaped as an elongated tubular box, is in communication with a manifold (21) positioned along the sides of the box (19). The overall surface of all the fingers constitutes the cathodic surface of the new cell module, which is about the same as the anodic one. The diaphragm is deposited onto the external surfaces of the fingers, as in the existing cathodic package. New copper current conducting bars (22) are fixed to the box (19) connected in parallel to the current bus bar (6) of the pre-existing cathodic body.

The cell of the invention, optionally obtained from a pre-existing cell according to the method of the present invention, operates as follows: the feed brine enters the cell through the inlet nozzle (10) placed on the cell cover and is distributed through pipe (23) to the base of the anodic compartment, subsequently rising to the top surface thereof and overflowing through the slots to the new anodic base (15). The chlorine evolved in the lower anodic compartment follows the same path and leaves through the outlet nozzle (9) on the cover (8). The chloride depleted electrolyte, driven by the pressure corresponding to the hydraulic head between the anolyte and catholyte, permeates through the diaphragm entering the upper (20) and lower (5) cathodic compartments. Hydrogen leaves the upper (21) and lower (7) cathodic compartments respectively through nozzles (25) and (11), connected in parallel to the hydrogen manifold (26). The alkali produced in the upper cathodic compartment (21) leaves through nozzle (27), and enters the lower cathodic chamber (7) through pipe (28) and nozzle (29), where it mixes with the alkali produced therein, then leaving the cell through the hydraulic head (12). In a particularly preferred embodiment of the invention, the level of the cathodic liquor is adjusted so that a sufficient gas chamber is always maintained in the lower cathodic compartment (7); consequently, the upper compartment (21) works exclusively as a gas chamber and electrolysis takes place only by direct contact between the solution percolating onto the diaphragm and the cathode. To establish such condition in a reliable fashion, the pipe (28) must obviously have a sufficient large diameter in order to remain substantially full of hydrogen, so that the two cathodic compartments (7) and (21) are subjected to an identical pressure.

EXAMPLE

A test was carried out in a diaphragm cell type MDC-55, commercialised by Eltech Systems Corporation, U.S.A., which represents one of the most common industrial cells currently operating. Before the retrofitting, the cell was operated at the following conditions:

| | |
|---|---|
| Current output | 145 kA |
| Current density: | 2.63 kA/$m^2$ |
| Anode/cathode voltage: | 3.60 V |
| Faradaic efficiency: | 93% |
| Energy consumption: | 2860 kWh/ton $Cl_2$ |
| Operating yield: | 95% |
| Kf: | 0.48 V $m^2$/kA |

The diaphragm was asbestos modified with SM-2, a polymeric material commercialised by Eltech Systems Corporation, U.S.A., known to the experts in the field for this use.

The cell was modified by installing a new module with a height of about 160 mm, in order to increase the electrodic surface by about 20% (from 55 to 66 $m^2$), with the aim of reducing the current density from 2.65 to 2 kA/$m^2$. The resulting voltage reduction was 0.3 V, corresponding to an energy saving of about 240 kWh/ton $Cl_2$ (8.6% of the total consumption).

The invention claimed is:

1. A diaphragm electrolytic cell for the electrolytic production of chlorine and alkali comprising a lower module equipped with a lower anodic package and a lower cathodic package and at least one upper module overlaid thereon equipped with an upper anodic package and an upper cathodic package, said modules being hydraulically connected in series, wherein said hydraulic connection in series comprises an external manifold for the product alkali and a direct fluid communication between said upper anodic package and said lower anodic package by means of holes or slots provided in a conductive frame.

2. The cell of claim 1 wherein said modules are electrically connected in parallel.

3. The cell of claim 2 wherein said lower anodic package is fixed to an anodic base, said at least one upper anodic package is fixed to a conductive frame and said anodic base and conductive frame are electrically connected in parallel by bus bars and are hydraulically connected in series.

4. The cell of claim 1 wherein said lower module comprises a lower anodic package and a lower cathodic package, and said at least one upper module comprises an upper anodic package and a lower cathodic package, each of the lower and upper anodic packages consisting of parallel rows of anodes and each of said lower and upper cathodic packages consisting of parallel rows of cathodes, said cathodes arranged in an interdigitated configuration with respect to said anodes, said anodes of said upper and lower anodic packages having the same projected surface and pitch, and said cathodes of said lower and upper cathodic packages having the same projected surface and pitch.

5. The cell of claim 4 wherein the surface of said anodes is a grid coated with an electrocatalytic material.

6. The cell of claim 4 wherein said cathodes comprise a perforated surface with a semipermeable diaphragm deposited thereon.

7. The cell of claim 6, wherein said diaphragm is selected from the group consisting of asbestos diaphragms, polymer-modified asbestos diaphragms, asbestos-free composite diaphragms, and ion-exchange membranes.

8. A method for the production of chlorine and alkali in a cell of claim 2 comprising:

feeding brine on the cell bottom up to substantially filling said upper and lower anodic packages evolving chlorine on the surface of said anodes, depleting said brine of chlorides allowing said depleted brine to permeate through the diaphragms of said cathodic packages adjusting the level of liquid inside said anodic packages so that said upper cathodic package and the upper part of said lower cathodic package are substantially free from liquid.

9. A method for increasing the electrodic surface of a diaphragm electrolytic cell for the production of chlorine and alkali, comprising a cover, at least one first module provided with an anodic package consisting of rows of anodes fixed onto an anodic base and a cathodic package consisting of parallel rows of cathodes interdigitated to said anodes, wherein it comprises adding at least one new module comprising a new anodic package consisting of rows of anodes fixed onto a frame and a new cathodic package interdigitated to said new anodic package between said at least one first module and the cover, said anodic package of said first module and said new anodic package are hydraulically connected in series, said hydraulic connection in series comprising an external manifold for the product caustic soda and a direct internal connection between said anodic package of said first module and said anodic package of said new module through a multiplicity of slots or holes provided in said frame.

10. The method of claim 9 wherein said at least one new module has a lower height than that of said at least one first module, said new anodic package and said new cathodic package having the same projected surface and pitch with respect to those of the anodic and cathodic packages of the at least one first module.

11. The method of claim 9 wherein said at least one new module and said at least one first module are electrically connected in parallel.

12. The method of claim 11 wherein said connection in parallel is carried out by at least one bus bar connecting said anodic base to said frame.

* * * * *